US009920915B2

(12) United States Patent
Xiong et al.

(10) Patent No.: US 9,920,915 B2
(45) Date of Patent: Mar. 20, 2018

(54) LIGHTING DEVICE AND LUMINAIRE

(71) Applicant: PHILIPS LIGHTING HOLDING B.V., Eindhoven (NL)

(72) Inventors: Yan Xiong, Shanghai (CN); Xiao Qiao Zhang, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/784,067

(22) PCT Filed: Apr. 7, 2014

(86) PCT No.: PCT/IB2014/060495

§ 371 (c)(1),
(2) Date: Oct. 13, 2015

(87) PCT Pub. No.: WO2014/167480

PCT Pub. Date: Oct. 16, 2014

(65) Prior Publication Data

US 2016/0061388 A1 Mar. 3, 2016

Related U.S. Application Data

(63) Continuation of application No. PCT/CN2013/074027, filed on Apr. 10, 2013.

(51) Int. Cl.
*F21V 29/00* (2015.01)
*F21V 23/00* (2015.01)
(Continued)

(52) U.S. Cl.
CPC ..... *F21V 23/005* (2013.01); *F21K 9/23* (2016.08); *F21K 9/238* (2016.08); *F21V 29/70* (2015.01);
(Continued)

(58) Field of Classification Search
CPC ..... F21V 29/70
(Continued)

(56) References Cited

U.S. PATENT DOCUMENTS

2004/0239242 A1 12/2004 Mano et al.
2009/0218923 A1 9/2009 Gingrich, III et al.
(Continued)

FOREIGN PATENT DOCUMENTS

CN 102449372 A 5/2012
EP 2302284 A2 3/2011
(Continued)

*Primary Examiner* — Elmito Breval
*Assistant Examiner* — Keith Delahoussaye

(57) ABSTRACT

Disclosed is a lighting device (100) comprising a carrier (10) having a main body (12) and first and second protrusions (14, 16) extending in parallel from said main body, the first protrusion comprising a first main surface (142) and an opposite second main surface (144), the second protrusion comprising a third main surface (162) and an opposite fourth main surface (164), wherein the first main surface and the third main surface are on the same side of the carrier, said carrier carrying at least one solid state lighting element (20) on at least one of the first main surface and the fourth main surface; and a heat dissipating member (30) having a first portion (32) thermally coupled to the second main surface and having a second portion (33) thermally coupled to the third main surface. A luminaire including such a lighting device is also disclosed.

20 Claims, 4 Drawing Sheets

(51) Int. Cl.

| | |
|---|---|
| ***F21V 29/70*** | (2015.01) |
| ***F21K 9/23*** | (2016.01) |
| ***F21K 9/238*** | (2016.01) |
| *F21Y 105/12* | (2016.01) |
| *F21Y 105/10* | (2016.01) |
| *F21Y 115/10* | (2016.01) |
| *F21Y 107/90* | (2016.01) |

(52) U.S. Cl.
CPC ..... *F21Y 2105/10* (2016.08); *F21Y 2105/12* (2016.08); *F21Y 2107/90* (2016.08); *F21Y 2115/10* (2016.08)

(58) Field of Classification Search
USPC ..... 362/249
See application file for complete search history.

(56) References Cited

U.S. PATENT DOCUMENTS

2009/0323325 A1* 12/2009 Long ..... F21K 9/00 362/234
2011/0163675 A1 7/2011 Lin et al.
2011/0204393 A1 8/2011 Masumoto et al.
2011/0298371 A1* 12/2011 Brandes ..... F21K 9/238 315/32
2011/0298374 A1* 12/2011 Lenk ..... H05B 33/0815 315/50
2012/0032577 A1 2/2012 Huang
2012/0069570 A1* 3/2012 Marinus ..... F21V 3/02 362/249.02
2012/0268936 A1 10/2012 Pickard et al.
2013/0163235 A1* 6/2013 Chuang ..... F21V 15/01 362/190
2014/0321126 A1* 10/2014 Narag, II ..... H05K 1/189 362/306

FOREIGN PATENT DOCUMENTS

JP 2009080966 A 4/2009
JP 2010055993 A 3/2010
WO 2012095758 A2 7/2012

* cited by examiner

LIGHTING DEVICE AND LUMINAIRE

CROSS-REFERENCE TO PRIOR APPLICATIONS

This application is the U.S. National Phase application under 35 U.S.C. § 371 of International Application No. PCT/IB2014/060495, filed on Apr. 7, 2014, which claims the benefit of International Application No. PCT/CN2013/074027, filed on Apr. 10, 2013. These applications are hereby incorporated by reference herein.

FIELD OF THE INVENTION

The present invention relates to a lighting device and a luminaire comprising such a lighting device.

BACKGROUND OF THE INVENTION

With a continuously growing population, it is becoming increasingly difficult to meet the world's energy needs as well as to control carbon emissions to kerb greenhouse gas emissions that are considered responsible for global warming phenomena. These concerns have triggered a drive towards more efficient energy consumption in an attempt to reduce energy consumption.

One such area of concern is lighting applications, either in domestic or commercial settings. There is a clear trend towards the replacement of energy inefficient incandescent light bulbs with more energy-efficient replacements. Indeed, in many jurisdictions the production and retailing of incandescent light bulbs has been outlawed, thus forcing consumers to buy energy-efficient alternatives, e.g. when replacing incandescent light bulbs. For example, the US government has initiated its Energy Star® programme, which includes a list of approved replacements of incandescent light bulbs such as compact fluorescent lamps and solid state lighting (SSL) devices, e.g. light emitting diode (LED)-based light bulbs.

It is generally recognized that SSL devices provide a particularly promising alternative due to their green credentials such as lifetime and energy consumption. SSL devices can produce a unit luminous output at a fraction of the energy cost of incandescent light bulbs. However, the commercial challenge with providing lighting devices based on SSL elements is to produce the lighting device at a cost point that makes the device accessible to large consumer volumes, as also recognized in the aforementioned Energy Star® programme. This is a far from trivial exercise. A typical SSL-based lighting device such as a light bulb contains several discrete components, such as a carrier for the one or more SSL elements, a carrier for the one or more SSL element driver circuits, a heat dissipating member to provide effective cooling to the electronic components on the various carriers, a reflector, beam shaping optics and so on, which makes the lighting device relatively complex and therefore costly.

Although it is technically straightforward to combine some of these components, e.g. a carrier such as a printed circuit board carrying both the SSL elements and the driver circuits, the impracticalities of such design choices cannot be easily overcome. For instance, the heat flux from a carrier on which both SSL elements and driver circuits are combined is such that this heat cannot be effectively dissipated by a heat dissipating member, e.g. a heat sink, thus causing overheating of the lighting device. For this reason, separate carriers are commonly used to delocalize the heat generation in the lighting device, despite the fact that this increases its manufacturing cost.

US 2012/0268936 A1 discloses a lighting element comprising plural heat sink regions on respective regions of a flexible circuit board, and plural light emitters on respective regions of the flexible circuit board. This however is a complex device that cannot be manufactured in a cost-effective manner.

SUMMARY OF THE INVENTION

The present invention seeks to provide a lighting device that can be manufactured in a more cost-effective manner.

The present invention further seeks to provide a luminaire including such a lighting device.

According to an aspect of the present invention, there is provided a lighting device comprising a carrier having a main body and first and second protrusions extending in parallel from said main body, the first protrusion comprising a first main surface and an opposite second main surface, the second protrusion comprising a third main surface and an opposite fourth main surface, wherein the first main surface and the third main surface are on the same side of the carrier, said carrier carrying at least one solid state lighting element on at least one of the first main surface and the fourth main surface; and a heat dissipating member having a first portion thermally coupled to the second main surface and having a second portion thermally coupled to the third main surface.

Such a lighting device benefits from the presence of a single carrier onto which the one or more SSL elements, e.g. LEDs are mounted, thereby reducing the cost of the lighting device whilst at the same time providing effective dissipation of the heat generated by the one or more SSL elements due to the fact that the heat dissipating member is thermally coupled to multiple surfaces of the carrier that do not carry any components or at least not carry SSL elements. Preferably, the at least one driver circuit is also mounted on the carrier, thereby further reducing the complexity and cost of the lighting device.

In an embodiment, said first portion is coupled to the second main surface and said second portion is thermally coupled to the third main surface via respective bonding members. Such bonding members, e.g. PTFE or silicone gel bonding members securely fit the carrier to the heat dissipating member whilst simultaneously providing electrical insulation between the carrier and the heat dissipating member.

The lighting device of claim may further comprise a housing and an exit window fitted to said housing, wherein said first and second protrusions extend in a direction in parallel with a main axis of the lighting device, said main axis extending through the housing and the exit window.

In other words, in this preferred embodiment, the carrier, e.g. a printed circuit board, is mounted vertically in the lighting device, which is an area-efficient manner of integrating the carrier in the lighting device.

In an embodiment, the heat dissipating member comprises a first heat dissipating portion; a second heat dissipating portion opposite the first heat dissipating portion; a bridging member comprising at least a part of the first portion and the second portion, said bridging member connecting the first heat dissipating portion to the second heat dissipating portion. In this embodiment, the bridging member thermally couples the first and second heat dissipating portions to respective protrusions of the carrier, such that a large area heat dissipating member is provided that can effectively dissipate the heat generated by the one or more SSL elements and driver circuits.

The shape of the first and second heat dissipating portions may match the shape of the housing to ensure a good fit of the heat dissipating member in the housing.

In an embodiment, the first portion further comprises a first further protrusion extending from the bridging member and being thermally coupled to the second main surface; and the second portion further comprises a second further protrusion extending from the bridging member and being thermally coupled to the third main surface. This ensures a particularly good heat transfer from the carrier to the heat dissipating member.

The lighting device preferably comprises a plurality of solid state lighting elements on at least one of the first main surface and the fourth main surface. The solid state lighting elements preferably are distributed over both the first main surface and the fourth main surface to increase the distribution of the luminous output of the lighting device. It has been found that in this embodiment a lighting device can be produced that is compliant with the Energy Star® requirements, especially when the lighting device further comprises a reflector to further increase the luminous distribution, i.e. to make the luminous distribution less directional. Such a reflector may for instance be mounted on the carrier.

The heat dissipating member preferably is formed from a single sheet of metal to provide a low-cost heat dissipating member. Aluminium is particularly preferred as the metal because it is cheap and easily pliable.

The lighting device may be a light bulb.

In accordance with another aspect of the present invention, there is provided a luminaire comprising the lighting device according to an embodiment of the present invention. Such a luminaire may for instance be a holder of the lighting device or an apparatus into which the lighting device is integrated.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
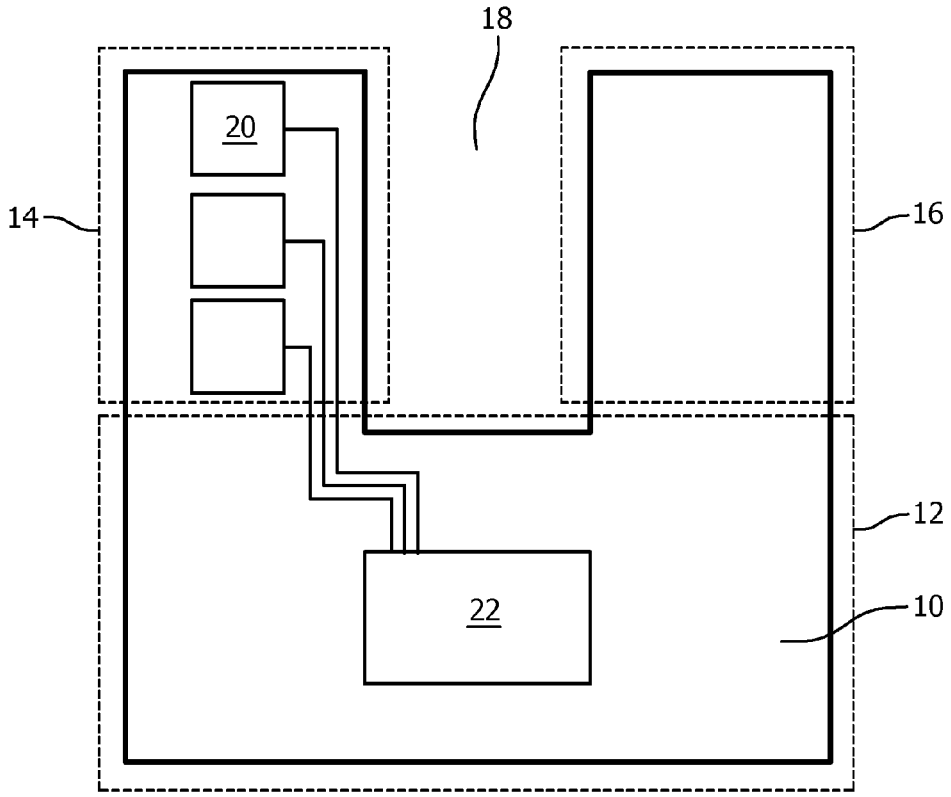
FIG. 1 schematically depicts an aspect of a lighting device according to an embodiment of the present invention.

It should be understood that the Figures are merely schematic and are not drawn to scale. It should also be understood that the same reference numerals are used throughout the Figures to indicate the same or similar parts.

Figure 2:
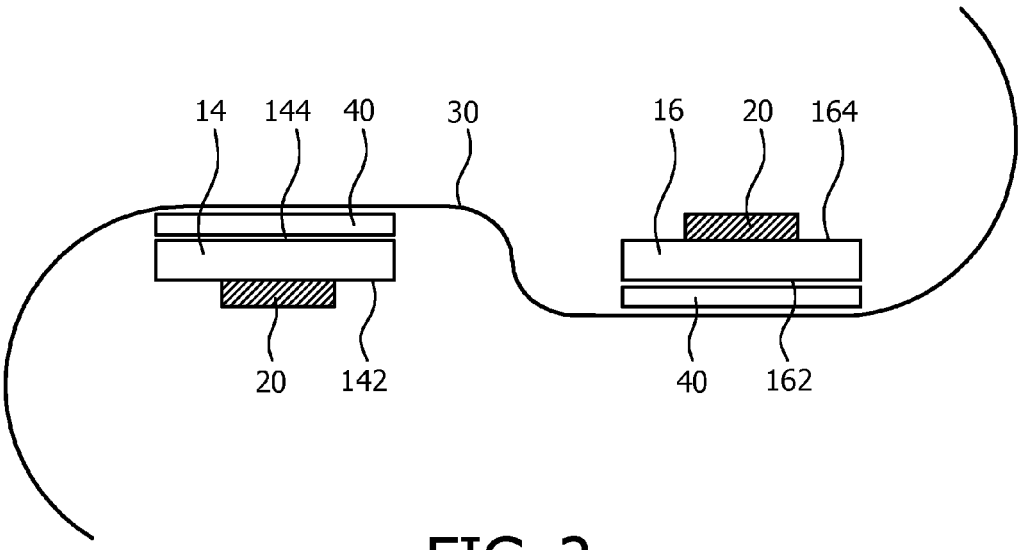
FIG. 2 schematically depicts another aspect of a lighting device according to an embodiment of the present invention.

FIGS. 1 and 2 respectively schematically depict a side view and a top view of a carrier 10 that forms part of the lighting device of the present invention. The carrier 10, which may be a printed circuit board, comprises a main body 12. A first protrusion 14 and a second protrusion 16 extend in parallel from the main body 10, thereby forming a recess 18 that is delimited by the main body 10, the first protrusion 14 and the second protrusion 16. In other words, the first protrusion 14 and the second protrusion 16 extend from the main body 12 in the plane of the main body 12. It is noted for the avoidance of doubt that the dashed boxes in FIG. 1 are merely identify the various portions of the carrier 10 and are not to be construed as somehow delimiting the carrier 10.

The first protrusion 14 has a first main surface 142 onto which one or more SSL elements 20 may be mounted in any suitable manner, e.g. by soldering. In FIG. 1, three SSL elements 20 are shown by way of non-limiting example only; it should be understood that the first main surface 142 may carry any suitable number of SSL elements 20, e.g. one or more SSL elements 20. The first protrusion 14 further has a second main surface 144 opposite the first main surface 142 for thermally coupling the carrier 10 to a first portion of a heat dissipating member 30, as will be explained in more detail later. It is noted that the heat dissipating member 30 is not shown in FIG. 1 for the sake of clarity only.

The second protrusion 16 has a fourth main surface 164 onto which one or more SSL elements 20 may be mounted. It should be understood that the fourth main surface 164 may carry any suitable number of SSL elements 20, e.g. one or more SSL elements 20, or no SSL elements 20 at all although the latter is not preferred. The second protrusion 16 further has a third main surface 162 opposite the fourth main surface 164 for thermally coupling the carrier 10 to a second portion of a heat dissipating member 30, as will be explained in more detail later. The first and third main surfaces 142 and 162 are on the same side of the carrier 10. The second and fourth main surfaces 144 and 164 are on the opposite side of the carrier 10.

The lighting device may further comprise a first bonding member 40 between the second main surface 144 and heat dissipating member 30 and a second bonding member 40 between the third main surface 162 and the heat dissipating member 30 for securing the heat dissipating member 30 to the carrier 10. The bonding members 40 preferably are of an electrically insulating material to electrically insulate the heat dissipating member 30 from the carrier 10. The bonding members 40 should have good heat conductive properties to establish a sufficient thermal coupling between the heat dissipating member 30 and the carrier 10. Non-limiting examples of suitable electrically insulating materials include polytetrafluoroethylene (PTFE) and silicone gel.

In an embodiment, the carrier 10 further comprises at least one driver circuit 22 for driving the SSL elements 20. The at least one driver circuit 22 may be located on any suitable part of the carrier 10. In FIG. 1, the driver circuit 22 is shown on the main body 12 of the carrier 10 by way of non-limiting example only. Alternatively, the driver circuit 22 may be located on the first main surface 142 or on the fourth main surface 164. More than one driver circuit 22 may be present on the carrier 10. For instance, a further driver circuit may be located on the other side of the main body 12. It should however be understood that it is not essential that the at least one driver circuit 22 is mounted on the carrier 10. Instead, the at least one driver circuit 22 may be provided on a separate carrier (not shown), in which case the carrier 10 will include wiring and a terminal for connecting the at least one driver circuit 22 to the SSL elements 20.

As can be seen in FIG. 2, the heat dissipating member 30 has a twisted structure such that a first portion of the heat dissipating member 30 is thermally coupled to the second main surface 144 of the first protrusion 14 and a second portion of the heat dissipating member 30 is thermally coupled to the third main surface 162 of the second protrusion 16. In the context of the present invention, the term 'thermally coupled' should be interpreted to mean two bodies in direct or indirect physical contact with each other, e.g. coupled to each other via a thermally conducting body, or at least located in close enough vicinity to each other to allow heat to be effectively transferred from the carrier 10 to the heat dissipating member 30.

Figure 3:
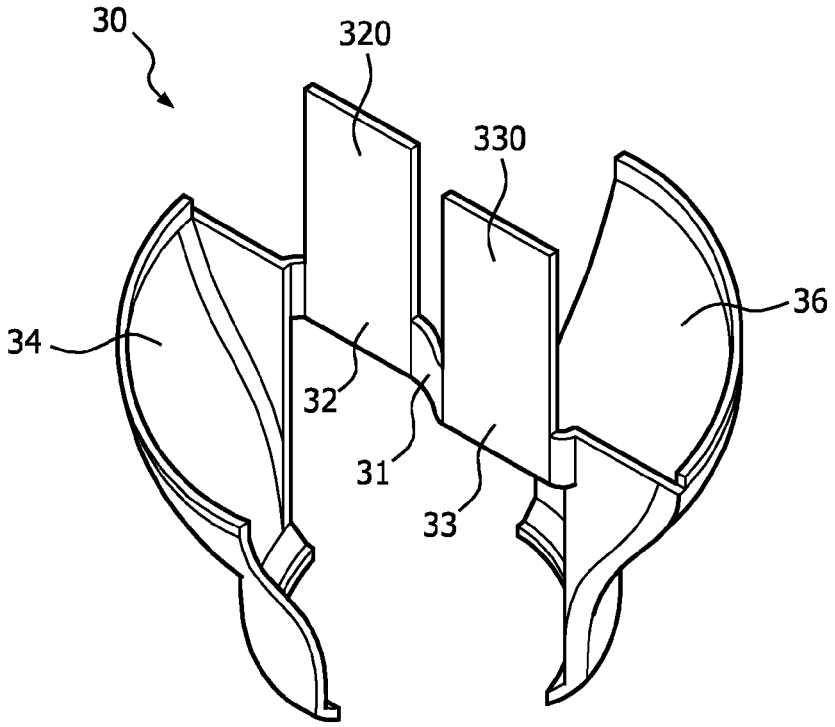
FIG. 3 schematically depicts yet another aspect of a lighting device according to an embodiment of the present invention.
Figure 4:
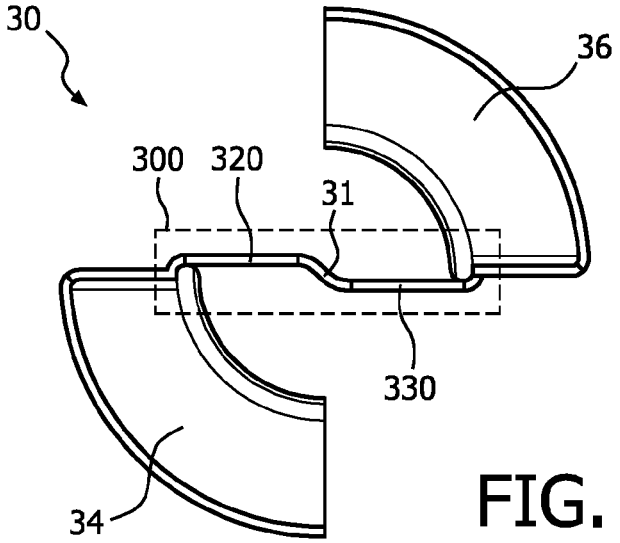
FIG. 4 schematically depicts yet another aspect of a lighting device according to an embodiment of the present invention.

FIG. 3 schematically depicts a perspective view and FIG. 4 schematically depicts a top view of a non-limiting example of a heat dissipating member 30 for use in a lighting device of the present invention. The heat dissipating member 30 comprises a bridging member 300 including at least part of a first portion 32 and a second portion 33 that is axially displaced respective to the first portion 32. In other words, the bridging member 300 has a stepped shape in which an intermediate portion 31 interconnects at least a part of the first portion 32 to at least a part of the second portion 33 and axially displaces the first portion 32 respective to the second portion 33 to obtain the stepped shape. The intermediate portion 31 is typically located in the recess 18 of the carrier 10 and rests on the upper portion of the main body 12 of the carrier 10. In FIGS. 3 and 4, the intermediate portion 31 is shown to have a curved shape by way of non-limiting example only. The intermediate portion 31 may have any suitable shape that can achieve the stepped profile of the bridging member 300; e.g. a z-shape or the like.

The first portion 32 is thermally coupled to the second main surface 144 of the first protrusion 14 and acts as a heat sink for this part of the carrier 10. The second portion 33 is thermally coupled to the third main surface 162 of the second protrusion 16 and acts as a heat sink for this part of the carrier 10. In other words, the heat generated by the SSL elements 20 on the first main surface 142 of the first protrusion 14 will be transferred via the second main surface 144 to the first portion 32 and the heat generated by the SSL elements 20 on the second main surface 164 of the second protrusion 16 will be transferred via the first main surface 162 to the second portion 33.

The heat dissipating member 30 further comprises a first heat dissipating portion 34 connected to the first portion 32 of the bridging member 300 for primarily dissipating the heat collected by the first portion 32 and a second heat dissipating portion 36 connected to the second portion 33 of the bridging member 300 for primarily dissipating the heat collected by the second portion 33. Although the first heat dissipating portion 34 and the second heat dissipating portion 36 may have any suitable form, it is preferred that the first heat dissipating portion 34 and the second heat dissipating portion 36 match the shape of the housing of the lighting device, as will be explained in more detail later. As will be understood by the skilled person, the respective areas of the first heat dissipating portion 34 and the second heat dissipating portion 36 preferably are made as large as possible to maximize the heat dissipation by the first heat dissipating portion 34 and the second heat dissipating portion 36.

In an embodiment, the first portion 32 further comprises a first further protrusion 320 extending from the bridging member 300 and being thermally coupled to the second main surface 144 of the first protrusion 14 and the second portion 33 further comprises a second further protrusion 330 extending from the bridging member 300 and being thermally coupled to the third main surface 162 of the second protrusion 16.

The further protrusions 320 and 330 may be used to increase or even maximize the thermal coupling between the heat dissipating member 30 and the carrier 10, thereby ensuring efficient cooling of the carrier 10 by the heat dissipating member 30. For this reason, it is preferable that the one or more driver circuits 22 are located on or in the vicinity of one of the first main surface 142 and the fourth main surface 164 to ensure that the heat generated by the one or more driver circuits 22 is effectively transferred to the heat dissipating member 30 via the thermal coupling between the second main surface 144 and the first portion 32 and the third main surface 162 and the third portion 33 respectively, which first portion 32 may include the first further protrusion 320 and which second portion 33 may include the second further protrusion 330.

The heat dissipating member 30 may be manufactured in any suitable manner, but preferably is manufactured from a single sheet of metal, e.g. by cutting, folding, bending and otherwise deforming the sheet of metal into the desired shape. Any suitable sheet metal may be used although aluminium is particularly suitable because of its low cost and pliability.

Figure 5:
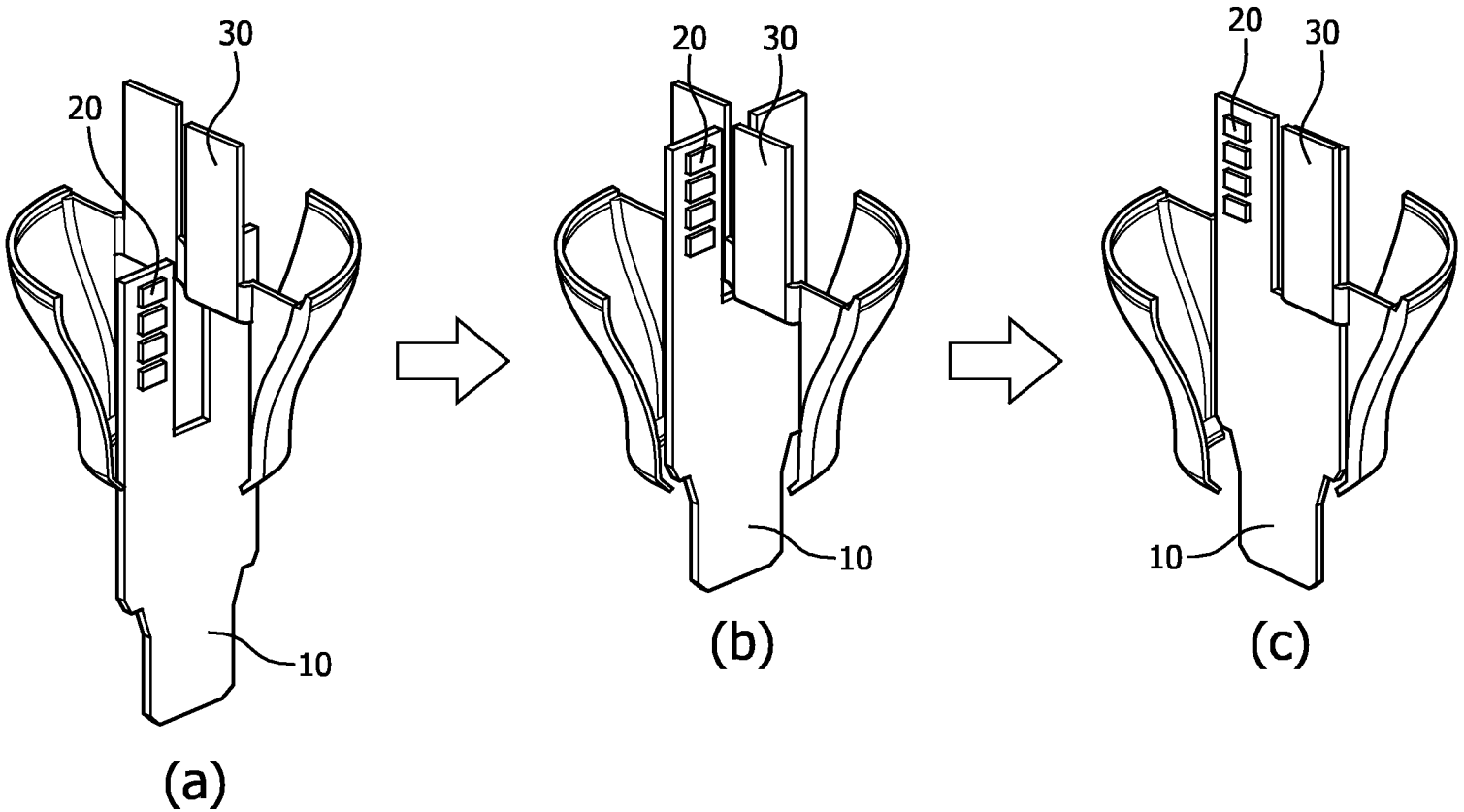
FIG. 5 schematically depicts a method of assembling part of a lighting device according to an embodiment of the present invention.

The carrier 10 and the heat dissipating member 30 may be assembled as shown in FIG. 5. In step (a), the intermediate portion 31 of the bridging member 300 is inserted into the recess 18 such that the first portion 32 and the second portion 33 of the bridging member 300 are oriented more or less perpendicularly to the first protrusion 14 and the second protrusion 16 of the carrier 10.

Upon completion of the insertion process as shown in step (b), when the intermediate portion 31 of the bridging member 300 comes to rest on the main body 12 of the carrier 10, the heat dissipating member 30 is twisted relative to the carrier 10 to arrive at the assembly shown in step (c), in which the first portion 32 of the bridging member 300 faces the second main surface 144 of the first protrusion 14 and is thermally coupled thereto and in which the second portion 33 of the bridging member 300 faces the third main surface 162 of the second protrusion 16 and is thermally coupled thereto.

Figure 6:
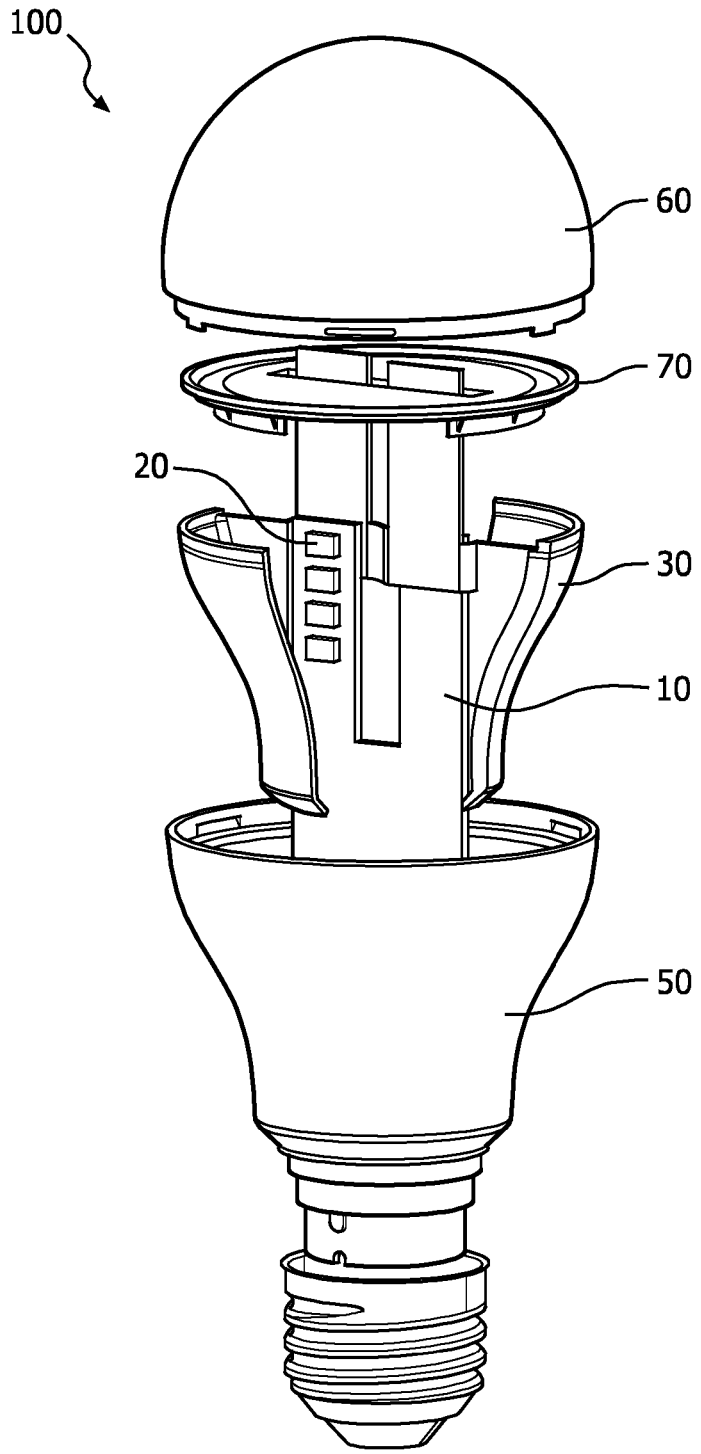
FIG. 6 schematically depicts a lighting device according to an embodiment of the present invention.

FIG. 6 schematically depicts a deconstructed model of a lighting device 100 according to an embodiment of the present invention. The lighting device 100 comprises a housing 50 into which the carrier 10 is fitted such that the one or more driver circuits 22 are electrically coupled to the conductive terminals (not shown) of the housing 50. The heat dissipating member 30 is engaged with the carrier 10 as previously explained. In other words, the carrier 10 is aligned with the principal axis of symmetry of the lighting device 100, e.g. is oriented vertically in the lighting device 100 when its principal axis is in a vertical orientation, such that the first protrusion 14 and the second protrusion 16 extend in a direction in parallel with this principal axis.

The lighting device 100 further comprises an exit window 60, which may be transparent or translucent, and may be made of any suitable material, e.g. glass or plastics. The exit window 60 typically engages with the housing 50 such that the internal volume of the lighting device 100 is delimited by the inner surfaces of the housing 50 and the exit window 60 respectively.

The lighting device 100 may further comprise a reflector 70 to shape the luminous output of the one or more SSL elements 20, e.g. LEDs, on the carrier 10. In FIG. 6, SSL elements 20 are only visible on the first main surface 142 of the first protrusion 14, but it should be understood that the lighting device 100 may further comprise one or more SSL elements 20, e.g. LEDs, on the fourth main surface 164 of the second protrusion 16, which is not visible in FIG. 6. The reflector 70 may be mounted in any suitable manner in the lighting device 100. For instance, the reflector 70 may be mounted on the protrusions 14, 16 of the carrier 10. In an embodiment, the reflector 70 is shaped such that it creates a luminous output distribution of the lighting device 100 that is compliant with the Energy Star® requirements, although it should be understood that alternative embodiments in which such compliance is not achieved are also feasible.

The lighting device 100 may comprise the same colour or different colour SSL elements. In this context, white light SSL elements having different colour temperatures are also considered different coloured SSL elements 20. For instance, the colours of the of SSL elements 20 on the first main surface 142 may be the same or may be different to each other. The colours of the of SSL elements 20 on the fourth main surface 164 may be the same or may be different to each other. The colours of the SSL elements 20 on the first main surface 142 may be the same as may be different to the colours of the SSL elements 20 on the fourth main surface 164.

In order to obtain a good fit of the assembly formed by the carrier 10 and the heat dissipating member 30 in the housing 50, the first heat dissipating portion 34 and the second heat dissipating portion 36 match the shape of the housing of the lighting device, as is shown in FIG. 6. In a particularly advantageous embodiment, the plastic housing 50 is moulded such that the heat dissipating member 30 is moulded into the housing 50. The first heat dissipating portion 34 and the second heat dissipating portion 36 of the heat dissipating member 30 are thermally coupled to the housing 50 such that the heat generated in particular by the SSL elements 20 can be effectively transferred to the housing 50, with the air surrounding the housing 50 providing further dissipation of this heat. Preferably, the first heat dissipating portion 34 and the second heat dissipating portion 36 of the heat dissipating member 30 are in physical contact with the inner surface of the housing 50.

The lighting device 100 according to embodiments of the present invention may be advantageously included in a luminaire such as a holder of the lighting device, e.g. a ceiling light fitting, or an apparatus into which the lighting device is integrated, e.g. a cooker hood or the like.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

a carrier having a main body and first and second protrusions extending in parallel from said main body and are separated by a gap, the first protrusion comprising a first main surface and an opposite second main surface, the second protrusion comprising a third main surface and an opposite fourth main surface, wherein the first main surface and the third main surface are on the same side of the carrier and extend within a first plane, said carrier carrying at least one solid state lighting element on the first main surface, and at least one solid state lighting element on the fourth main surface, wherein the first and second protrusions are integrally formed with the carrier; and a heat dissipating member including at least one mathematical inflection point and having a first portion thermally coupled to the second main surface and having a second portion thermally coupled to the third main surface, the heat dissipating member extending through the gap separating the first and second protrusions and crossing the first plane.

2. The lighting device of claim 1, wherein said first portion is coupled to the second main surface and said second portion is thermally coupled to the third main surface via respective bonding members.

3. The lighting device of claim 1, further comprising at least one driver circuit on the carrier.

4. The lighting device of claim 1, further comprising a housing and an exit window fitted to said housing, wherein said first and second protrusions extend in a direction in parallel with a main axis of the lighting device, said main axis extending through the housing and the exit window.

5. The lighting device of claim 1, further comprising a reflector mounted on the carrier.

6. The lighting device of claim 1, wherein the heat dissipating member defines a curvilinear surface, the curvilinear surface crossing the plane.

7. The lighting device of claim 1, wherein the at least one solid state lighting element is a light emitting diode.

8. A luminaire comprising the lighting device of claim 1.

9. The lighting device of claim 1 wherein the heat dissipating member comprises:

a first heat dissipating portion;

a second heat dissipating portion opposite the first heat dissipating portion; and a bridging member comprising at least a part of the first portion and the second portion, said bridging member connecting the first heat dissipating portion to the second heat dissipating portion, wherein the bridging member extends through the gap and crosses the first plane.

10. The lighting device of claim 9, wherein the first and second heat dissipating portions match the shape of a housing.

11. The lighting device of claim 9, wherein:

the first portion further comprises a first further protrusion extending from the bridging member and being thermally coupled to the second main surface; and the second portion further comprises a second further protrusion extending from the bridging member and being thermally coupled to the third main surface.

12. The lighting device of claim 1, wherein the lighting device comprises a plurality of solid state lighting elements on at least one of the first main surface and the fourth main surface.

13. The lighting device of claim 12, wherein the plurality of solid state lighting elements are distributed over the first main surface and the fourth main surface.

14. The lighting device of claim 1, wherein the heat dissipating member is formed from a single sheet of metal.

15. The lighting device of claim 14, wherein the metal is aluminium.

16. A lighting device comprising:

a carrier having a main body and first and second protrusions extending in parallel from said main body and being separated by a gap, the first protrusion comprising a first main surface and an opposite second main surface, the second protrusion comprising a third main surface and an opposite fourth main surface, wherein the first main surface and the third main surface are on the same side of the carrier and extend within a first plane, wherein the second main surface and the fourth main surface are on the same side of the carrier and extend within a second plane, the first plane and the second plane being parallel, said carrier carrying at least one solid state lighting element on the first main surface and at least one solid state lighting element on the fourth main surface, wherein the carrier is planar; and a heat dissipating member including at least one mathematical inflection point and having a first portion thermally coupled to the second main surface and having a second portion thermally coupled to the third main surface.

17. The lighting device of claim 16, further comprising a housing and an exit window fitted to said housing, wherein said first and second protrusions extend in a direction in parallel with a main axis of the lighting device, said main axis extending through the housing and the exit window.

18. The lighting device of claim 16 wherein the heat dissipating member comprises:

a first heat dissipating portion;

a second heat dissipating portion opposite the first heat dissipating portion; and a bridging member comprising at least a part of the first portion and the second portion, said bridging member connecting the first heat dissipating portion to the second heat dissipating portion.

19. The lighting device of claim 18, wherein the first and second heat dissipating portions match the shape of a housing.

20. The lighting device of claim 18, wherein:

the first portion further comprises a first further protrusion extending from the bridging member and being thermally coupled to the second main surface; and the second portion further comprises a second further protrusion extending from the bridging member and being thermally coupled to the third main surface.

* * * * *